US006311826B1

(12) United States Patent
Tischler

(10) Patent No.: US 6,311,826 B1
(45) Date of Patent: Nov. 6, 2001

(54) APPARATUS FOR HANDLING SHEET METAL ITEMS COMPRISING A DECLUSTERING STATION FOLLOWED BY AT LEAST ONE CONVEYING STATION AND/OR PROCESSING STATION AND/OR WORKING STATION

(75) Inventor: Gerhard Tischler, Ravensburg (DE)

(73) Assignee: Schuler Automation GmbH & Co. KG, Hessdorf (DE)

( * ) Notice: Subject to any disclaimer, the term of this patent is extended or adjusted under 35 U.S.C. 154(b) by 0 days.

(21) Appl. No.: 09/453,057

(22) Filed: Dec. 2, 1999

(30) Foreign Application Priority Data

Dec. 22, 1998 (DE) ..... 198 59 302

(51) Int. Cl.[7] ..... B65G 43/08
(52) U.S. Cl. ..... 198/395
(58) Field of Search ..... 198/395, 502.2, 198/434

(56) References Cited

U.S. PATENT DOCUMENTS 4,511,242 * 4/1985 Ashbee et al. ..... 355/14
4,860,879 * 8/1989 Harsch et al. ..... 198/395
5,231,675 * 7/1993 Sarr et al. ..... 382/8
5,314,055 * 5/1994 Gordon ..... 198/395

* cited by examiner

*Primary Examiner*—Donald P. Walsh
*Assistant Examiner*—Joseph Rodriguez
(74) *Attorney, Agent, or Firm*—Browdy and Neimark

(57) ABSTRACT

An apparatus for handling sheet metal items comprises a declustering station for such items arriving in a stack followed by at least one conveying station and/or processing station and/or working station, which convey away, process and work the sheet metal items. At one station at least there are individual members to be adapted to the outline of the items, as for instance positioning abutments. There is an outline detecting means with an associated data processing computer for finding the outline of the sheet metal items. Power-operated setting means are associated with the individual members, said power-operated setting means being connected with a setting computer. This data processing computer processes the outline data to produce setting values and the setting computer converts the setting values into control signals for the setting means so that the individual members are adapted to the respective sheet metal item outline.

11 Claims, 1 Drawing Sheet

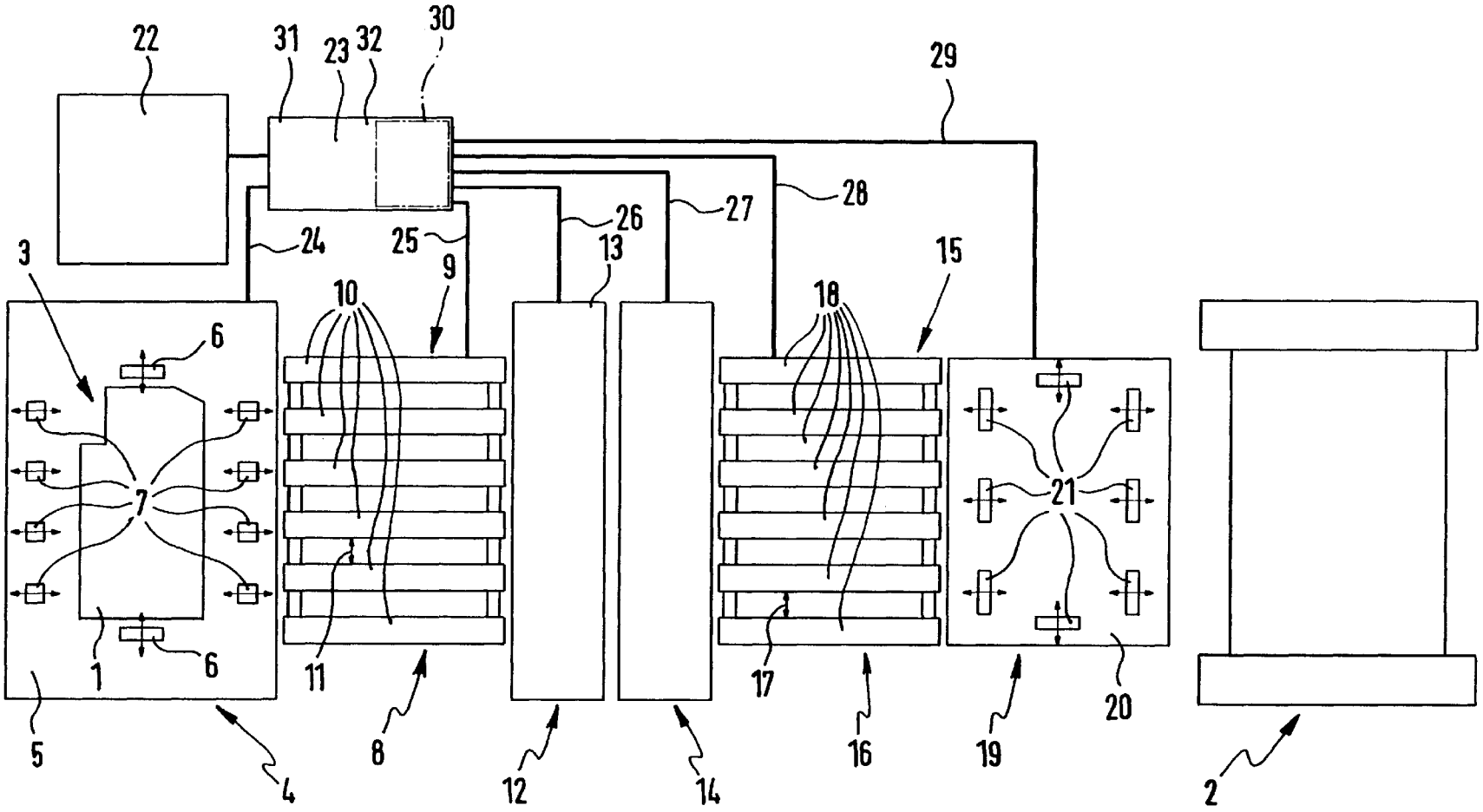
2
20
21
19
29
15
16
28
18
17
27
14
26
13
12
30
9
25
8
32
23
10
11
31
24
4
22
6
6
7
1
3
5

APPARATUS FOR HANDLING SHEET METAL ITEMS COMPRISING A DECLUSTERING STATION FOLLOWED BY AT LEAST ONE CONVEYING STATION AND/OR PROCESSING STATION AND/OR WORKING STATION

BACKGROUND OF THE INVENTION

The invention relates to an apparatus for handling sheet metal items comprising a declustering station for such items arriving in a stack followed by at least one conveying station and/or processing station and/or working station, which convey away, process and work the sheet metal items, at one station at least there being individual members to be adapted to the outline of the items, as for instance positioning abutments.

Such an apparatus is employed for the mass production of sheet metal parts, as for instance in connection with a press receiving such items. In this respect between the declustering station and the press it is possible for a washing station for example be installed for washing the sheet metal items, an oiling station for the application of an oil film and a positioning station, in which the sheet metal items are moved into the right position prior to transfer into the press. In these treatment stations and in the declustering station the individual members are located, which must be set to the shape or outline of the respective sheet metal items arriving in an already cut condition in the declustering station. In this respect it is a question of, for example, positioning abutments more particularly in the declustering station and in the centering station, of members setting the pressure and/or the amount of the washing fluid employed in the washing station or spraying nozzles arranged in the oil applying station for the oil, which produce the respectively required spray pattern on the respective sheet metal item. Furthermore feed conveying means for the sheet metal items are present between the said stations, such means being able to be termed conveying stations. In this case as well adaptation to the to the shape of the sheet metal items may be necessary, as for example when it is a question of conveyor belts, which are divided up into a plurality of narrower individual belts, whose distance apart must be reset.

It will be clear that the invention is not limited to this apparatus, which is only indicated for the sake of example. In fact the invention will apply to all such apparatus, in the case of which the sheet metal items in the course of processing to yield finished components meet with some sort of individual members, which in some way or other contribute to the processing of the sheet metal items as same are converted into finished sheet metal components and in this respect must be adjusted to the outline or shape of the sheet metal items.

Such adjustment is normally performed by hand prior to the start of sheet metal component manufacture. If there is a change-over to the manufacture of other sheet metal components, it is necessary for the apparatus to be retooled.

This is however a task which is heavy on labor, more particularly when it is a question of small production runs.

Accordingly one object of the present invention is to provide a device of the initially described type in the case of which adaptation of the individual members takes place in a substantially simpler fashion.

In order to achieve these and/or other objects appearing from the present specification, claims and drawings, in the present invention there is an outline detecting means with an associated data processing computer for finding the outline of the sheet metal items, power-operated setting means being associated with the individual members, said power-operated setting means being connected with a setting computer, said data processing computer processing the outline data obtained to produce setting values and the setting computer converting the setting values into control signals for the setting means so that the individual members are adapted to the respective sheet metal item outline.

It is in this manner that, by means their setting means and under the control of a computer, the individual member are adapted to the sheet metal items of the respective stack of sheet metal items. This may take place automatically if the data processing computer is constituted by a computer unit, within which the setting values are automatically converted into the control signals. When the first stack of sheet metal items meets with the first outline detecting means, the apparatus will, as it were, program itself.

The data processing computer and the setting computer may also be separate from each other so that either the data processing computer comprises a data output issuing the setting values on data medium able to be read by the setting computer and the setting computer having a reading means for reading the data medium or the data processing computer converting the setting values into a form able to be read by the person operating the apparatus and the setting computer having an input means for the manual input of the setting values. In these cases it is necessary for the operator to be active, since he has to put the data medium, as for instance a diskette, in the setting computer or has to perform input of such setting values to the setting computer. However in this case as well slow retooling operations no longer occur.

Once the individual members are set, it is possible for the outline detecting means to be switched off as long as the apparatus is handling the same sheet metal items. It may however remain continuously in operation or be switched on intermittently at those points in time, at which a new stack of sheet metal items arrives.

In this connection it is possible for there to be a provision such that the data processing computer comprises a comparison means for the comparison of the position and/or outline of the sheet metal items with the previous stack of sheet metal items, it being possible for the comparison means to be connected with a recognition means, which responds when a departure is detected during comparison and informs the environment of the departure.

It is in this manner that it is possible to automatically detect when one of the sheet metal items has been placed in the apparatus in the wrong manner by error.

The outline detecting means is then preferably constituted by a camera system.

Further advantageous developments and convenient forms of the invention will be understood from the following detailed descriptive disclosure of one embodiment thereof in conjunction with the accompanying drawing, showing the apparatus in accordance with the invention in a very diagrammatic form in plan view, the outline the outline detecting, which is located in reality above the declustering station, being illustrated alongside same in order to make the drawing more straightforward.

DESCRIPTION OF PREFERRED EMBODIMENT OF THE INVENTION.

With the aid of the apparatus as depicted the sheet metal items 1 supplied in a stacked condition are subjected to different treatments on their way to a press 2 for deforming them and producing a sheet metal component, as for example part of the bodywork of a motor vehicle. For this the sheet metal items pass through the following stations in the illustrated case:

A sheet metal item stack 3 constituted by identical and already cut sheet metal items 1, is placed in a declustering station 4 on a base 5 and with the aid of positioning abutments 6 is positioned, such abutments being able to be moved toward the stack and away from the stack as indicated by the double arrows and in their active position rest against the periphery of the stack. Of the total number of these positioning abutments 6 present two are indicated symbolically. In the declustering station 4 spreading magnets 7 are furthermore arranged distributed about the periphery of the stack 3, such magnets also being able to be moved toward the sheet metal item stack 3 and away from the same (see the double arrows indicated), which during operation are directly adjacent to the periphery of the stack and when they are magnetically activated lead to spreading of the sheet metal item stack so that the top sheet metal items in the peripheral zone are lifted from the respectively underlying sheet metal item.

The positioning abutments 6 and the spreading magnets 7 constitute individual members, which must be adapted in position to the outline of the sheet metal item 1. They are then able to perform reciprocating movements out of the position illustrated as indicated by double arrows, which are necessary on putting fresh stack 3 of sheet metal items in place. In the drawing they are illustrated set at a distance from the stack of sheet metal items. On the contrary during operation of the apparatus they are on the periphery of the stack.

During operation the sheet metal items 1 are raised by means of a transfer means (not illustrated) separately from the stack 3 and placed in a following conveying station 8 on conveyor belt 9, which in the working example is divided up into individual belts 10 running in parallelism to one another and at a distance apart. Dependent on the size of the sheet metal items 1 and therefore also in a manner dependent on the sheet metal item outline a larger or a smaller distance 11 is necessary between the individual belts 10. The individual belts 10 are therefore arranged in an adjustable means (not illustrated) for setting in the direction of the distance 11 so that the individual belts 10 may as well be termed individual members able to be adapted to the respective sheet metal items.

The conveyor belt 9 conveys the respective sheet metal item 1 to a washing machine 13 located in a washing station 12, in which machine 13 the sheet metal item is cleaned with a suitable washing material, whose pressure and rate may be adjusted so that there is again an adaptation to the respective sheet metal items. The washing station 12 thus also comprises individual members able to be adapted to the respective sheet metal items, such members here feeding the washing material at the required pressure and correct rate.

The sheet metal items 1 running through the washing machine 13 in sequence are then conveyed through an oil applying station 14, in which they are provided with an oil film. The oil applying station 14 follows the washing station directly, the conveyance of sheet metal items through these two stations being performed by thrusting along by means of the conveyor belt 9 until the sheet metal items are engaged at the outlet of the oil applying station 14 by a further conveyor belt 15, following the oil applying station 14, which conveyor belt is responsible for further conveyance.

In the oil applying station 14 nozzles, not illustrated, are present for spraying on the oil, such nozzles also representing individual members, which are adapted to the outline of the sheet metal items in order to produce the correct spray pattern on the sheet metal items.

The further conveyor belt 15 comprised in the following conveyor space 16 is designed just like the conveyor belt 9 and also accordingly comprises a plurality of individual belts 18 arranged at a distance 17 apart, the distance 17 being able to be adjusted and accordingly adapted to the outline of the sheet metal items.

The sheet metal items 1 are moved one after the other by the conveyor belt 15 to a centering station 19, in which they are put on a base 20. From the centering station 19 the sheet metal items are moved into the press 2 with the aid of a transfer means, not illustrated. The sheet metal items must here assume an exactly predetermined position. In order to ensure this positioning abutments 21 are provided in the centering station 21, which may be the same as the positioning abutments 6 in the declustering station 4 and are arranged in accordance with the periphery of the sheet metal items 1 along same. In this respect it is possible for the positioning abutment 21 to be moved in the direction of the respectively indicated double arrow to and fro so that as a sheet metal item is moved between same and the base 20 the sheet metal item is moved into the desired position and accordingly centered. On removal of the respective sheet metal item and on placing the next sheet metal item in place the positioning abutments 21 will be moved back into their setting remote from the sheet metal item periphery. It will be apparent that these positioning abutments 21 as well constitute individual members, whose setting must be adjusted prior to starting operation of the apparatus to suit the desired outline of the sheet metal items. In these set initial positions the positioning abutments 21 are then able to be reciprocated as indicated by the double arrows.

Apparatus with the stations described so far is known. In this respect in the present context the design of the stations is unimportant. The only significant point is that in at least one station individual members are present to be adapted to the outline of the sheet metal items.

It will be clear that it may be a question of other stations than those described or that further stations may be added, as for instance one or more stations for working the sheet metal items.

In the declustering station 4 an outline detecting means 22 is provided for finding or detecting the outline of the sheet metal items 1. This outline detection means 22 is located not as illustrated in the drawing (in which In order to make the drawing more straightforward it is illustrated alongside the base 20 for the respective stack 3 of sheet metal items) but above the base 20. In this respect it is possible for the outline detection means 22 to be for example constituted by a suitable camera system. With the aid of the outline detection the means 22 it is possible for the outline or shape of the respective sheet metal item stack 3 to be found.

Within a computer unit 23 the outline detection means 22 is connected with a data processing computer 31, which processes the outline data produced for the sheet metal item stack to produce setting values, which are converted in a setting computer 32 of the computer unit 23 into control signals for power setting means, not illustrated, such power means being associated with the individual members, arranged in the different stations, as for example in the form of the positioning abutments 6 and 21, the spreading magnets 7 and the declustering belts 10 and 18.

The said individual member, which are to be adapted to the outline of the sheet metal items in the stack 3, are accordingly connected with a power setting means, which may be actuated by means of the computer unit 23 so that the respective individual member is set to the required degree.

Once the first sheet metal item stack 3 has been placed on the base 5 and once the outline detection means 22 has been switched on, the computer unit 23 will feed the required control signals via the control lines 24, 25, 26, 27, 28 and 29 to the different stations 4, 8, 12, 16 and 19 so that the individual member located here are brought into position. The apparatus is thus self-programming, as it were, during the first passage of the sheet metal items through it. The outline detection means 22 may then be turned off.

The outline detection means 22 does not have to be located in the declustering station 4 and can be arranged preceding it in the direction of processing or somewhere else. It will be clear that the respective sheet metal item stack 3 is placed in the declustering station in the desired true position. If desired there may also be a provision such that the outline detection means is also employed for recognition of position.

In the illustrated case the data processing computer 31 and the setting computer 32 are constituted by the computer unit 23 so that the setting values are automatically converted within the computer unit 23 into the control signals. The term "computer unit" is to be understood to mean that the data processing computer and the setting computer may also be separated from one another in space while being connected together in a conducting manner or being able to be so connected so that the manner of operation is the same.

Instead of this it would also be possible for the data processing computer and the setting computer to be separate from one another, the data processing computer comprising a data output for the setting values on a data storage medium able to be read by the setting computer, such setting computer having a reading means for reading the data storage medium. In the case of this design, which is not illustrated, using the data processing computer data storage medium, for instance in the form of a diskette is used, which is placed in the setting computer for conversion of the setting values into control signals for the setting means. In this case it is possible for the data storage medium to be produced to be on call and only to be placed in the setting computer for use when necessary and a sheet metal item stack with the corresponding outline is to be processed.

As an alternative to this it is possible for the arrangement to be such that, again using separate computers, the data processing computer produces or issues the setting values in a form able to be read by the operator, for example in a printed form, the setting computer then having an input means for the manual input of the setting values.

In all embodiments it is possible for the data processing computer 31 to comprise a comparison means 30 as indicated in chained lines, with which the position and/or the outline of the respective sheet metal item stack 3 may be compared with the position or, respectively, outline of the preceding sheet metal item stack 3. It is in this manner that it is possible to ascertain whether the respectively new sheet metal item stack has been deposited exactly in the true position and whether a stack of differently shaped sheet metal items has not been supplied in error. It will be clear that in such a case the outline detection means 22 must always be switched on, when a new sheet metal item stack arrives.

The comparison means 30 can be connected with a recognition means, which is not illustrated, and which detects and responds if the new stack on comparison is found to depart from the old previous stack, such departure being communicated to the environment. This recognition means may for example comprise an indicating means or produce an audible signal.

What is claimed is:

1. An apparatus for handling sheet metal items, said apparatus comprising:

a declustering station for receiving the items arriving in a stack;

at least one further station for receiving each item from the stack in sequence;

a plurality of individual members located at least one of the stations, each of said members being positionable to be adapted to the outline of each of the items;

outline detecting means for producing outline data representing the outline of each of the sheet metal items with an associated data processing computer for processing the outline data to produce setting values;

power operated setting means associated with each of said individual members for positioning each of said individual members; and a setting computer connected with said power operated setting means;

wherein said setting computer is operative for converting the setting values into control signals for the setting means for causing said individual members to be positioned in accordance with the outline of each sheet metal item.

2. The apparatus of claim 1 wherein said further station is at least one of a conveying station for conveying the sheet metal items, a processing station for processing the sheet metal items and a working station for working the sheet metal items.

3. The apparatus of claim 1 wherein said individual members include positioning abutments.

4. The apparatus of claim 1, wherein said data processing computer and said setting computer are constituted by one computer unit within which the setting values are automatically converted into the control signals.

5. The apparatus of claim 1, wherein said data processing computer and said setting computer are separate from one another, said data processing computer has a data output of the setting values to a data storage medium readable by the setting computer, and said setting computer has reading means for reading the data storage medium.

6. The apparatus of claim 1, wherein the processing computer and the setting computer are separate from each other, the data processing computer is adapted for output of the setting values in a form able to be read by an operator, and the setting computer has an input means for the manual input of the setting values.

7. The apparatus of claim 1, wherein the data processing computer comprises a comparison means for comparison of at least one of the position and outline of sheet metal items of one stack with sheet metal items of a previous stack.

8. The apparatus of claim 7, further comprising a recognition means connected with said comparison means for responding to comparisons made by said comparison means to produce an indication when a comparison indicates that the out line of sheet metal items of the one stack is different from the outline of sheet metal items of the previous stack.

9. The apparatus of claim 1, wherein the outline detecting means is constituted by a camera system.

10. The apparatus of claim 1, wherein the outline detecting means is arranged ahead of, or in, the declustering station.

11. The apparatus of claim 1, further comprising a press adapted to receive and shape the sheet metal items.

* * * * *